United States Patent [19]

Benages

[11] Patent Number: 4,872,210

[45] Date of Patent: Oct. 3, 1989

[54] CURBSIDE MAILBOX SIGNAL

[76] Inventor: Alexander Benages, 1585 Lakeview Dr., Hillsborough, Calif. 94010

[21] Appl. No.: 173,555

[22] Filed: Mar. 25, 1988

[51] Int. Cl.[4] ..... G08B 13/08

[52] U.S. Cl. ..... 340/569; 340/545; 200/61.63

[58] Field of Search ..... 340/568, 569, 570, 545; 200/61.02, 61.63

[56] References Cited

U.S. PATENT DOCUMENTS

| | | | |
|---|---|---|---|
| 3,611,333 | 10/1971 | Conigliaro | 340/569 |
| 3,909,819 | 9/1975 | Radford | 340/569 |
| 4,282,518 | 8/1981 | Bonner | 340/566 |
| 4,520,350 | 5/1985 | Huang | 340/569 |
| 4,651,135 | 3/1987 | Duhaime et al. | 340/569 |

*Primary Examiner*—Joseph A. Orsino
*Assistant Examiner*—Jeffery A. Hofsass
*Attorney, Agent, or Firm*—Julian Caplan

[57] ABSTRACT

A signal device is mounted on the inside of the door of a curbside mailbox. Opening and then closing the door closes a switch (mechanical switch, gravity actuated, a mercury switch or a photo diode) to emit a radio signal. A receiver in the residence, when actuated by the radio signal, notifies the occupant by an audible and/or visual signal.

6 Claims, 3 Drawing Sheets

CURBSIDE MAILBOX SIGNAL

BACKGROUND OF THE INVENTION

1. Field of the Invention

This invention relates to a new and improved curbside mailbox signal, and more specifically to a transmitter installed on the door of a curbside mailbox which contains a power source and a switch plus circuitry including an antenna to transmit a radio signal when the door of the box is opened. The switch may be either a gravity-sensitive switch which senses the opening of the door, a mercury-type switch, a photo device which is actuated by the light entering the box when the door is opened or other suitable switch means. At a remote point a receiver is installed which emits a signal and/or illuminates a light upon receipt of the radio signal from the transmitter. A reset button at the receiver is actuated when the box-owner becomes aware of the signal from the box.

2. Description of Related Art

Many curbside box signals have been used and references showing such use are supplied to the U.S. Patent and Trademark Office herewith. The present invention is an improvement upon all such references known to the inventor in that the transmitter is installed in a casing affixed to the inside of the door of the box in such position that when the box is opened a signal is transmitted without the use of an antenna installed on the box. In other words, it is not necessary to form openings in the box for an external antenna connection.

SUMMARY OF THE INVENTION

A casing comprising a switch and a transmitter and a power source is attached by pressure-sensitive adhesive, etc., to the inside of the door of a mailbox. When the door is opened, the switch is closed, transmitting a radio frequency signal. The switch may be of various types such as a gravity-sensitive switch or a light-sensitive switch. A feature of the invention is the fact that the radio signal is transmitted while the door is opened and therefore it is not necessary to install an external antenna on the mailbox. The casing has a double faced pressure- sensitive adhesive tape applied to one surface thereof, the exposed pressure-sensitive being shielded by release paper. Merely by removing the release paper and applying pressure to the casing, the device sticks to the inside of the door of the box. Accordingly, a principal feature of the invention is the ease with which the device may be installed in the mailbox and the fact that it is not necessary to form holes in the box for an external antenna as in prior art devices.

Another feature of the invention is the fact that the signal is emitted when the door is opened, thereby making the use of an external antenna unnecessary.

In the residence or wherever the radio frequency signal is received, there is a receiver. An audible signal is given when the radio signal is received, and an LED is energized. The LED is illuminated until a reset button is pushed by the user.

Other objects of the present invention will become apparent upon reading the following specification and referring to the accompanying drawings in which similar characters of reference represent corresponding parts in each of the several views.

DESCRIPTION OF PREFERRED EMBODIMENTS

Figure 1:
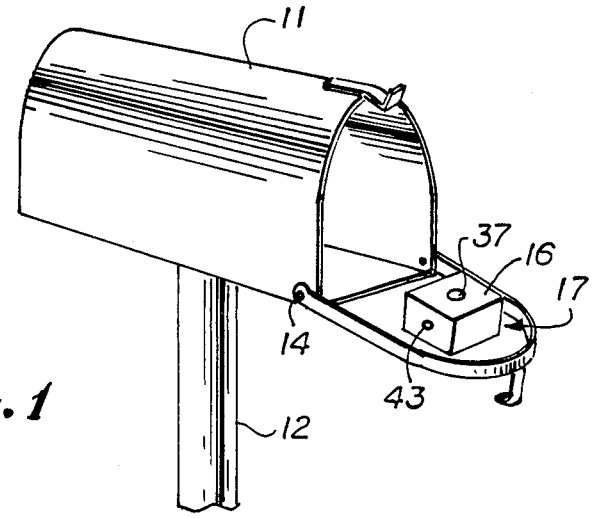
FIG. 1 is a schematic perspective view showing the transmitter installed on the inside of a mailbox door.
Figure 1A:
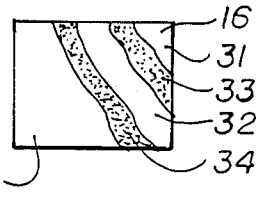
FIG. 1A is a plan view of the casing of the receiver broken away in layers to reveal construction.

In FIG. 1 there is shown a conventional sheet metal curbside-style mailbox 11, which may be supported on a post 12 or other suitable support, having a door 13 attached by hinges 14 to the bottom of the opening in the box 11. Such boxes 11 are conventional and are subject to considerable variation within the spirit of the present invention. When the postman delivers mail, he opens the door 13. It is this opening of the door which causes a radio frequency signal to be emitted.

The casing 16 is of plastic or other suitable material and contains therein switch means 17, a battery 18 (a 9-volt battery is suitable), and an antenna 19 internal of the casing 16. One of the broad bottom faces 31 of casing 16 is provided with a double-stick tape 32, having first pressure-sensitive adhesive 33 on one surface thereof which sticks to the bottom 31 and a second pressure-sensitive layer 34 which is initially protected by release paper 35. By pulling off the release paper 35, the adhesive 34 may be stuck to the inside of the door 13.

Figure 2:
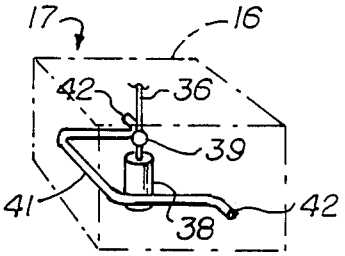
FIG. 2 is a schematic sectional view through the casing showing a gravity-sensitive switch.

The switch means 17 may be of various types. One gravity-type switch is shown schematically in FIG. 2. The upper end of flexible cable 36 is suspended from the top of casing 16 by extending up to the top of casing 16 through a hole 37 and being soldered in place. Weight 38 is connected to the lower end of cable 36 by swivel 39. A generally U-shaped wire 41 has out-turned ends 42 which extend through holes 43 in the side of casing 16 and are soldered in place.

When the door 13 is closed, weight 38 is out of contact with wire 41, but when the door is opened, weight 38 makes electrical contact with wire 41, thereby closing the circuit which energizes the radio transmitter. When the door is re-closed, electrical contact is broken.

Instead of a gravity-sensitive switch means, a light-sensitive switch may be substituted. Such a switch (not shown but well understood in the electronics trade) closes when the door is opened and light reaches the casing 16. Thus a hole covered by a transparent material may be formed in the casing 16 so that the light-sensitive switch is energized.

Figure 3:
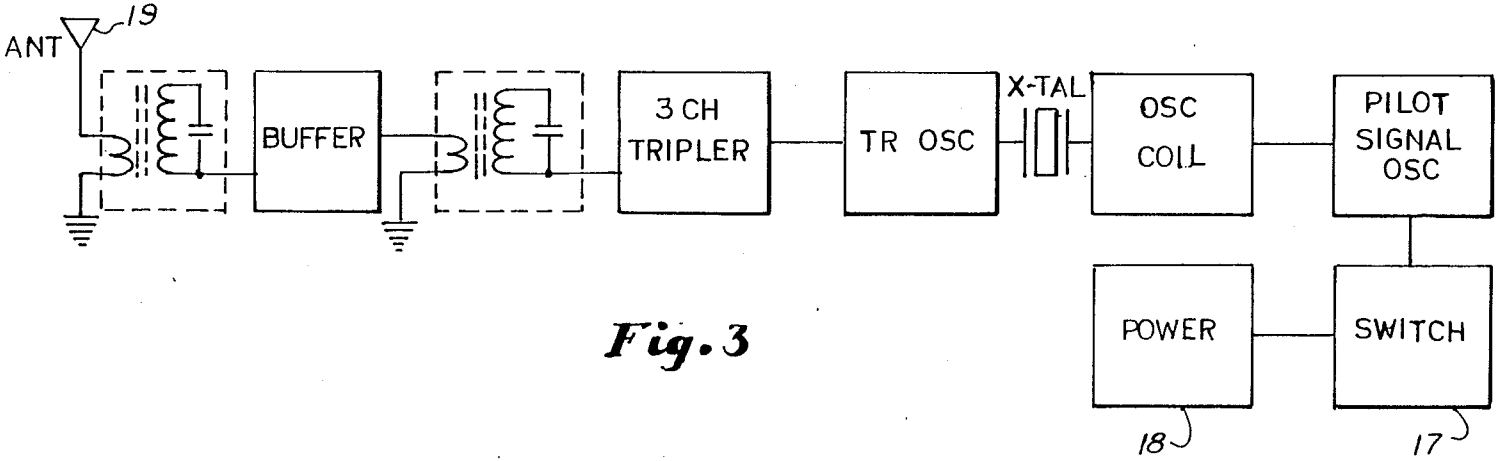
FIG. 3 is a block diagram of the transmitter.
Figure 4:
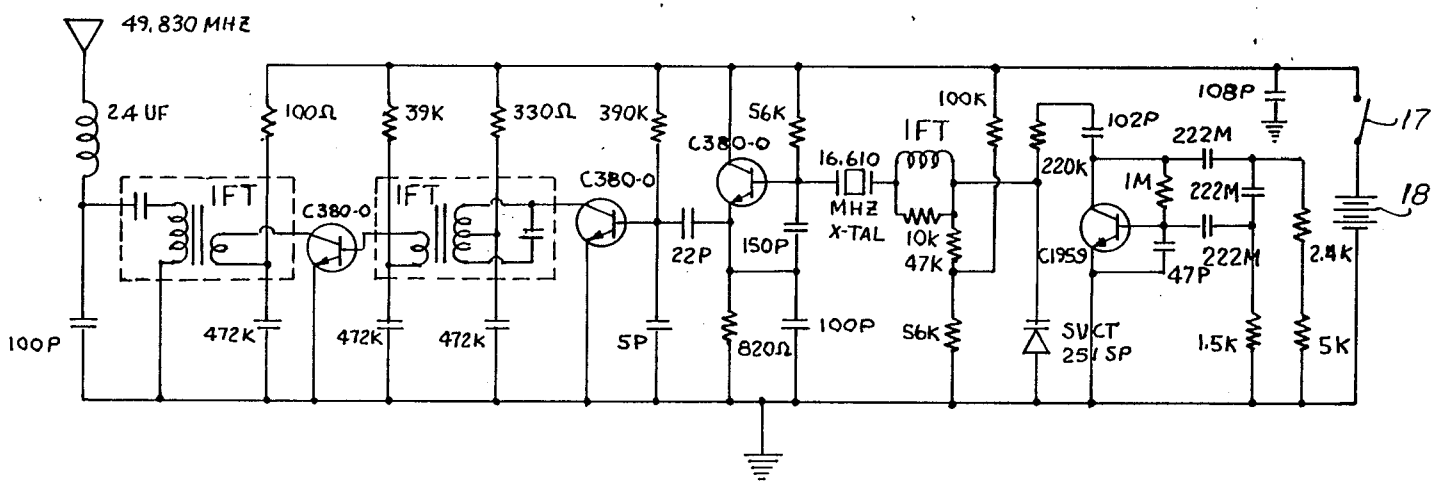
FIG. 4 is a schematic wiring diagram for the transmitter.

FIGS. 3 and 4 illustrate one suitable radio frequency transmitter which may be used in accordance with the present invention. The details of the transmitter are subject to wide variation. The circuitry shown in FIG. 4 will be readily understood by those skilled in the art and the schematic block diagram of FIG. 3 illustrates how the circuitry may be varied to accomplish the desired result. Antenna 19 is located interiorly of the casing 16. Because the signal is emitted when the door 13 is open, an external antenna is not required.

Figure 7:
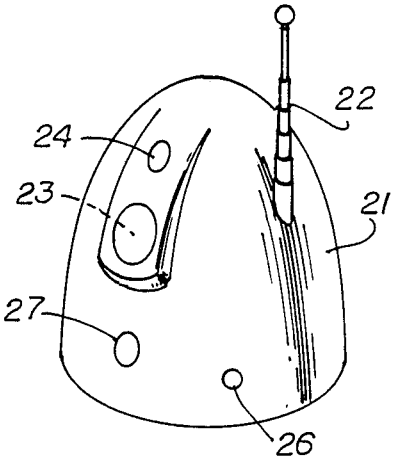
FIG. 7 is a perspective view of the receiver.

FIG. 7 shows one form of receiver. Casing 21, which may be used, is subject to wide variation. An antenna 22 extends from the casing 21 and receives the signal from the antenna 19 of the transmitter 16. Receipt of the signal causes a buzzer 23 to emit a musical tone advising the user that the mailbox 11 has been opened. An LED 24 is illuminated so that if the user does not hear the signal from the buzzer 23, observation of the illumination of the LED 24 is notification that the door 13 has been opened. A reset button 27 is pushed to recycle the receiver 21 after mail has been removed from the box 11. The receiver 21 may be energized in various ways, such as by a battery (not shown). A preferred means of energization is the use of a transformer which is plugged into a conventional household plug. An OFF-ON light 26 on casing 21 indicates that the power is turned on.

Figure 5:
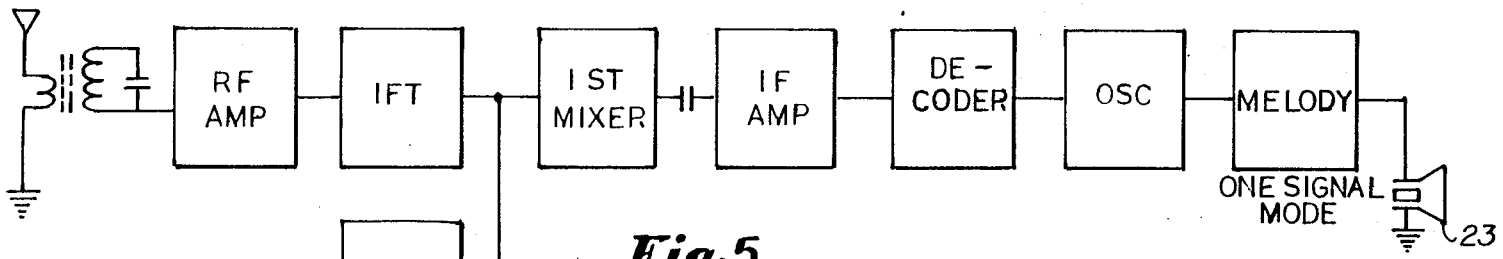
FIG. 5 is a schematic block diagram of the receiver.
Figure 6:
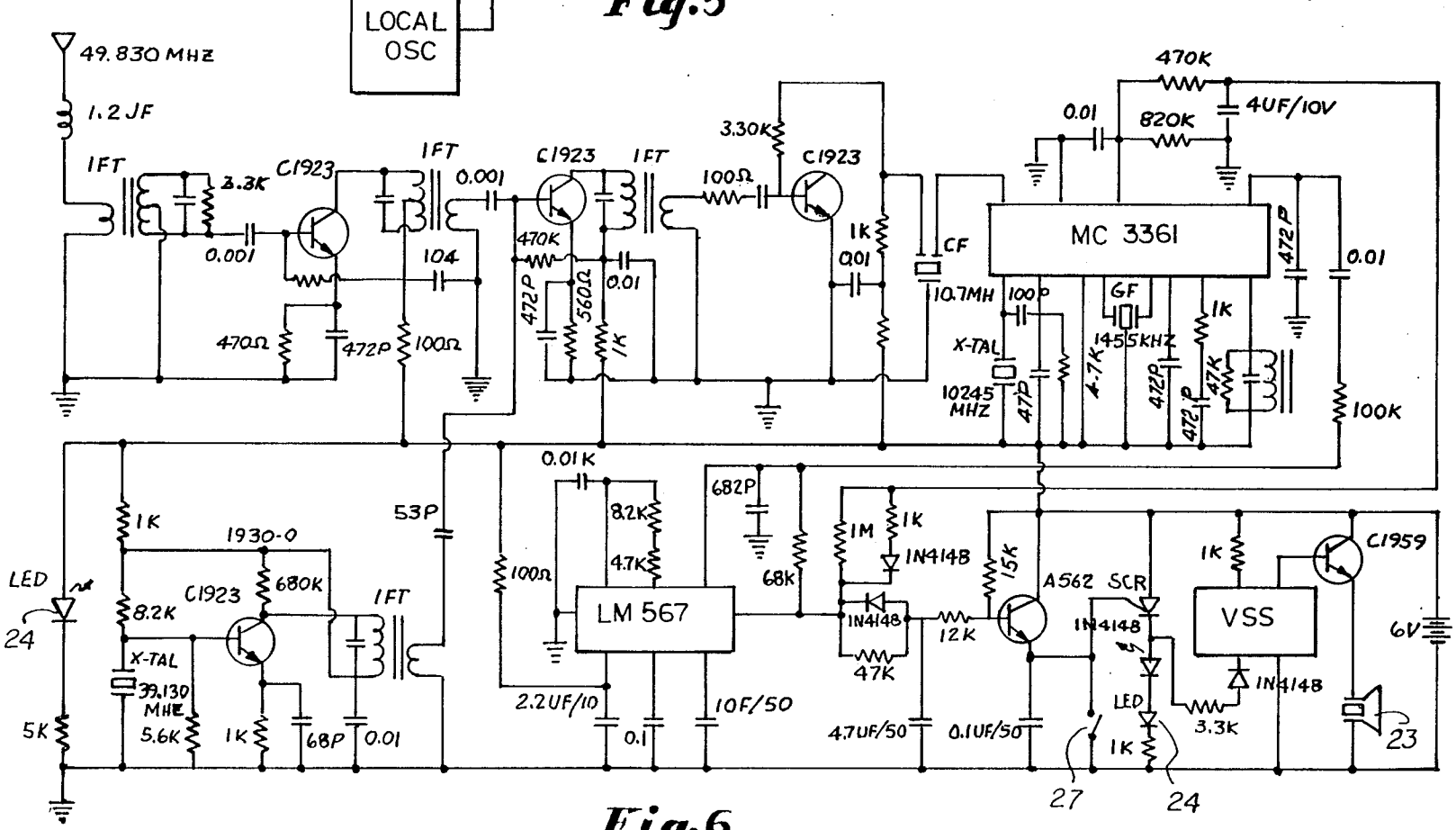
FIG. 6 is a wiring diagram for the receiver.

FIGS. 5 and 6 illustrate the circuitry of one form of receiver 21 both schematically and in considerable detail. It will be understood that considerable variation in the details of FIG. 6 are permissible within the scope of the invention.

I claim:

1. A curbside mailbox signal for use on a mailbox having a door, comprising a first casing enclosing power means, an r.f. transmitter and a first antenna, a switch operable to be closed upon opening of the door to energize said transmitter from said power means to emit a signal from said first antenna and means for attaching said first casing to the inside of said door, whereby when said door is opened said first antenna is exposed exteriorly of said mailbox; and a second casing adapted to be positioned remote from said first casing comprising an r.f. receiver having a second antenna tuned to said first antenna, and a power source for said receiver and signal emitting means enabled by said receiver upon receipt of a signal from said transmitter; said mailbox being characterized by the absence of an external antenna.

2. A signal according to claim 1 in which said switch comprises a first contact, means pivotally mounting said first contact about a horizontal axis, a weight on said first contact and a second contact, whereby said weight maintains said first contact away from said second contact when said door is closed and moves said first contact to electrical engagement with said second contact when said door is open.

3. A signal according to claim 1 in which said switch comprises a light-sensitive diode which is energized when external light reaches said diode when said door is open.

4. A signal according to claim 1 in which said signal emitting means comprises a buzzer.

5. A signal according to claim 1 in which said signal emitting means comprises an LED visible from the exterior of said second casing.

6. A signal according to claim 1 which further comprises a manual reset switch to disable said signal emitting means.

* * * * *